US009355536B2

(12) United States Patent
Crawley et al.

(10) Patent No.: US 9,355,536 B2
(45) Date of Patent: May 31, 2016

(54) RESONANCE DRIVER FOR DETERMINING A RESONANT FREQUENCY OF A HAPTIC DEVICE

(71) Applicant: Fairchild Semiconductor Corporation, San Jose, CA (US)

(72) Inventors: Philip J. Crawley, Oceanside, CA (US); Majid Shushtarian, Pleasanton, CA (US)

(73) Assignee: Fairchild Semiconductor Corporation, San Jose, CA (US)

( * ) Notice: Subject to any disclaimer, the term of this patent is extended or adjusted under 35 U.S.C. 154(b) by 240 days.

(21) Appl. No.: 13/930,096

(22) Filed: Jun. 28, 2013

(65) Prior Publication Data

US 2014/0085064 A1 Mar. 27, 2014

Related U.S. Application Data

(60) Provisional application No. 61/706,343, filed on Sep. 27, 2012.

(51) Int. Cl.

| | |
|---|---|
| ***G08B 21/00*** | (2006.01) |
| ***G08B 6/00*** | (2006.01) |
| ***B06B 1/02*** | (2006.01) |

(52) U.S. Cl.

CPC ..... *G08B 6/00* (2013.01); *B06B 1/0246* (2013.01)

(58) Field of Classification Search

CPC ..... G08B 6/00

USPC ..... 340/407.1, 407.2; 345/173; 310/15, 23, 310/36, 81, 317; 73/579

See application file for complete search history.

(56) References Cited

U.S. PATENT DOCUMENTS

2011/0102162 A1 5/2011 Gregorio et al.
2011/0243537 A1 10/2011 Wilson et al.

FOREIGN PATENT DOCUMENTS

CN 103699215 A 4/2014

OTHER PUBLICATIONS

"Chinese Application Serial No. 201320603071.1, Notification to Make Rectification mailed Jan. 9, 2014", w/English Translation, 3 pgs.

"Chinese Application Serial No. 201320603071.1, Response filed Feb. 28, 2014 to Notification to Make Rectification mailed Jan. 9, 2014", w/English Claims, 24 pgs.

*Primary Examiner* — Jeffery Hofsass

(74) *Attorney, Agent, or Firm* — Schwegman Lundberg & Woessner, P.A.

(57) ABSTRACT

This document discusses, among other things, apparatus and methods for controlling a haptic transducer. In an example, a haptic controller can include an active termination driver having a configurable output impedance. The active termination driver can be configured to drive a haptic transducer and to process back electro-magnetic force (EMF) of the haptic transducer to provide motion feedback of the haptic transducer. In an example, the haptic controller can include a processor to provide a command signal to the active termination driver and to determine a resonant frequency of the haptic device using the motion feedback of the haptic transducer.

17 Claims, 2 Drawing Sheets

RESONANCE DRIVER FOR DETERMINING A RESONANT FREQUENCY OF A HAPTIC DEVICE

CLAIM OF PRIORITY

This application claims the benefit of priority under 35 U.S.C. 119 to Crawley et al., U.S. Provisional Patent Application No. 61/706,343, filed Sep. 27, 2012, which is hereby incorporated by reference herein in its entirety.

OVERVIEW

This document discusses, among other things, apparatus and methods for controlling a haptic transducer. In an example, a haptic controller can include an active termination driver having a configurable output impedance. The active termination driver can be configured to drive a haptic transducer and to process back electro-magnetic force (EMF) of the haptic transducer to provide motion feedback of the haptic transducer. In an example, the haptic controller can include a processor to provide a command signal to the active termination driver and to determine a resonant frequency of the haptic device using the motion feedback of the haptic transducer.

This overview is intended to provide a general overview of subject matter of the present patent application. It is not intended to provide an exclusive or exhaustive explanation of the invention. The detailed description is included to provide further information about the present patent application.

BACKGROUND

Haptic reproduction can refer to, among other things, techniques that can provide a corresponding touch sensation when a finger touches a display, for example. The touch sensation can be produced by control of a certain physical effect prompt associated with, or part of, the display.

Haptic reproduction can provide physical feedback to electronic man-machine interactions. Haptic response in consumer electronics may improve user experience. For example, a physical touch response to a display pushbutton can provide a user with assurance that a button of a display was activated without seeing a visual indication or hearing an audio indication of the activation.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
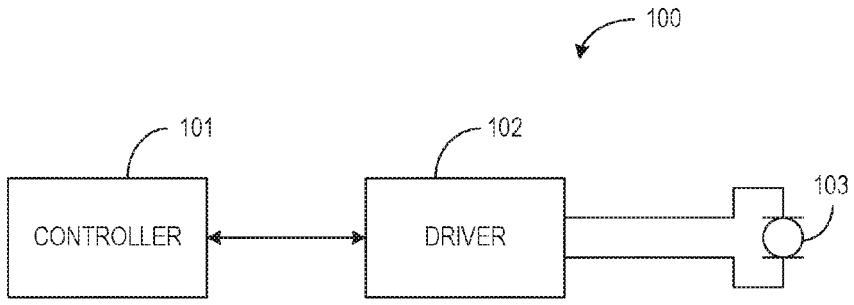
FIG. 1 illustrates generally and example haptic controller including a processor, an active termination driver and a resonant haptic transducer.

The present inventors have recognized apparatus and methods for providing improved control of resonant haptic devices. FIG. 1 illustrates generally and example haptic controller 100 including a processor 101, an active termination driver 102 and a resonant haptic transducer 103. In certain examples, the processor 101 can be part of an electronic device, including but not limited to, a computer or a mobile electronic device. The processor 101 can receive user inputs or application outputs and can provide command signals to the active termination driver 102 to drive the resonant haptic transducer 103. The active termination driver 102 can respond to the command signals and provide drive signals too cause the resonant haptic transducer 103 to accelerate, decelerate or maintain a commanded motion. In certain examples, the active termination driver 102 can include an amplifier and a second active device configurable to provide a predetermined output impedance of the active termination driver 102. In certain examples, the resonant haptic device 103 can include an eccentric rotating mass or a linear resonant actuator.

Figure 2:
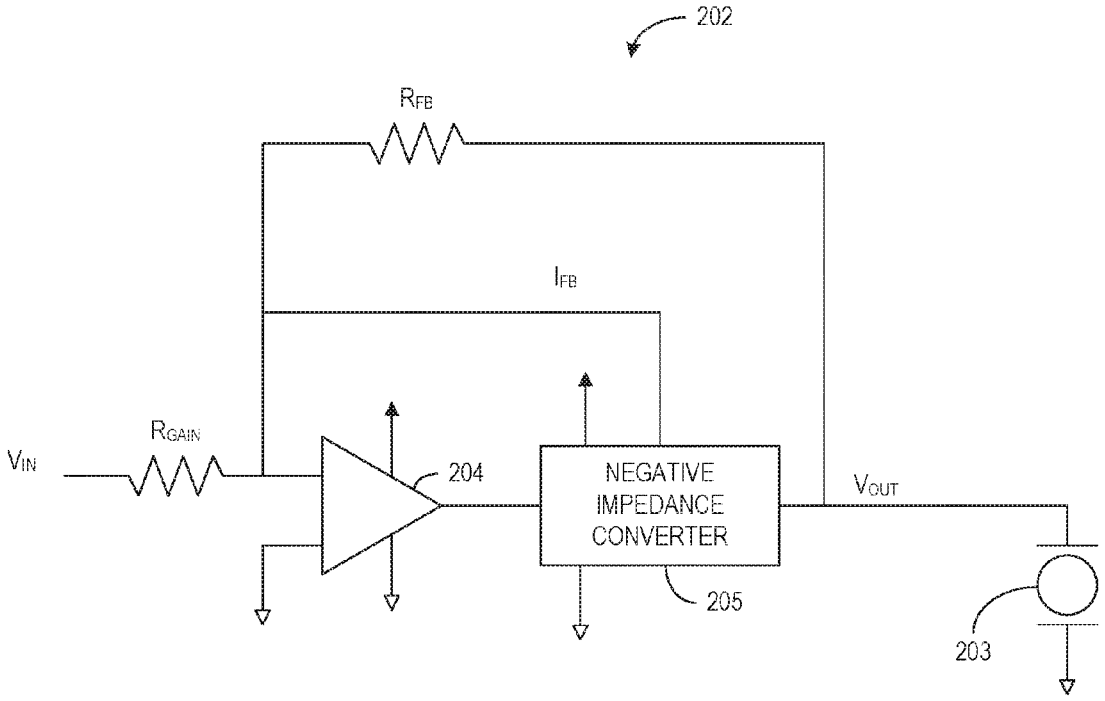
FIG. 2 illustrates generally an example active termination driver.

FIG. 2 illustrates generally an example active termination driver 202. In certain examples, the active termination driver 202 can include an amplifier 204 and a negative impedance converter 205. In certain examples, the amplifier can receive command signals ($V_{IN}$) from a processor (not shown) and can provide drive signals ($V_{OUT}$) to a haptic transducer 203. In some examples, a gain resistor ($R_{GAIN}$) and a feedback resistor ($R_{FB}$) can be matched to provide a proper amplitude signal to the haptic transducer 203. In some examples, the processor can provide impedance commands to the negative impedance converter 205 to adjust the output impedance of the active termination driver 202. In certain examples, adjusting the impedance of the active termination driver output can improve the ability of the processor to determine the resonant frequency of the haptic transducer 203. In some examples, adjusting the impedance of the active termination driver output can provide additional braking control of the resonant haptic transducer 203.

With regards to determining the resonant frequency of the haptic transducer 203, more robust and efficient control of the haptic transducer 203 can be maintained if the actual resonant frequency of the haptic transducer 203 is known. In most cases, a nominal resonant frequency of the haptic transducer 203 is known. However, environmental conditions such as temperature and humidity can affect the resonant frequency of the haptic transducer 203. The processor can execute a method of driving the haptic transducer 203, such as driving the haptic transducer 203 at or near the nominal resonant frequency and then monitoring the motion of the haptic transducer 203 to determine the actual resonant frequency. In certain examples, the back electromagnetic force (EMF) of the haptic transducer 203 can be monitored. In certain examples, the negative impedance converter 205 can filter and amplify the back EMF of the haptic transducer 203 to provide more robust measurements, and in turn, more accurate determination of the resonant frequency of the haptic transducer 203. In an example, the processor can drive the haptic transducer 203 at the nominal frequency, the processor, or the active termination driver 205, can then measure the maximum peak, and minimum peak of the amplified back EMF of the resulting motion of the haptic transducer 203, for example, using a peak detector. The maximum peak and the minimum peak of the amplified back EMF can then be used to determine the period of the resonant frequency of the haptic transducer 203. In some examples, the timing between the maximum and minimum peak can be used to determine the resonant frequency. In some examples, the maximum and minimum peaks can provide a threshold zero-crossing value for a zero-crossing detector to use to determine the period of the resonant frequency. In certain examples, the zero-crossing value can be a value approximately halfway between the maximum peak and the minimum peak. In some examples, timing information associated with two sequential zero-crossing detections of the back EMF of the haptic transducer can provide an indication of the period of the resonant frequency of the haptic transducer.

With regards to providing additional braking control, the processor can provide commands, such as digital commands, to the negative impedance converter 205 to change the impedance of the active termination driver output to allow the haptic transducer 203 to decelerate more quickly in certain examples. In certain example, the negative impedance converter can provide current feedback ($I_{FB}$) to assist in calibrating or configuring operation of the active termination driver 202 with haptic transducer 203.

Figure 3:
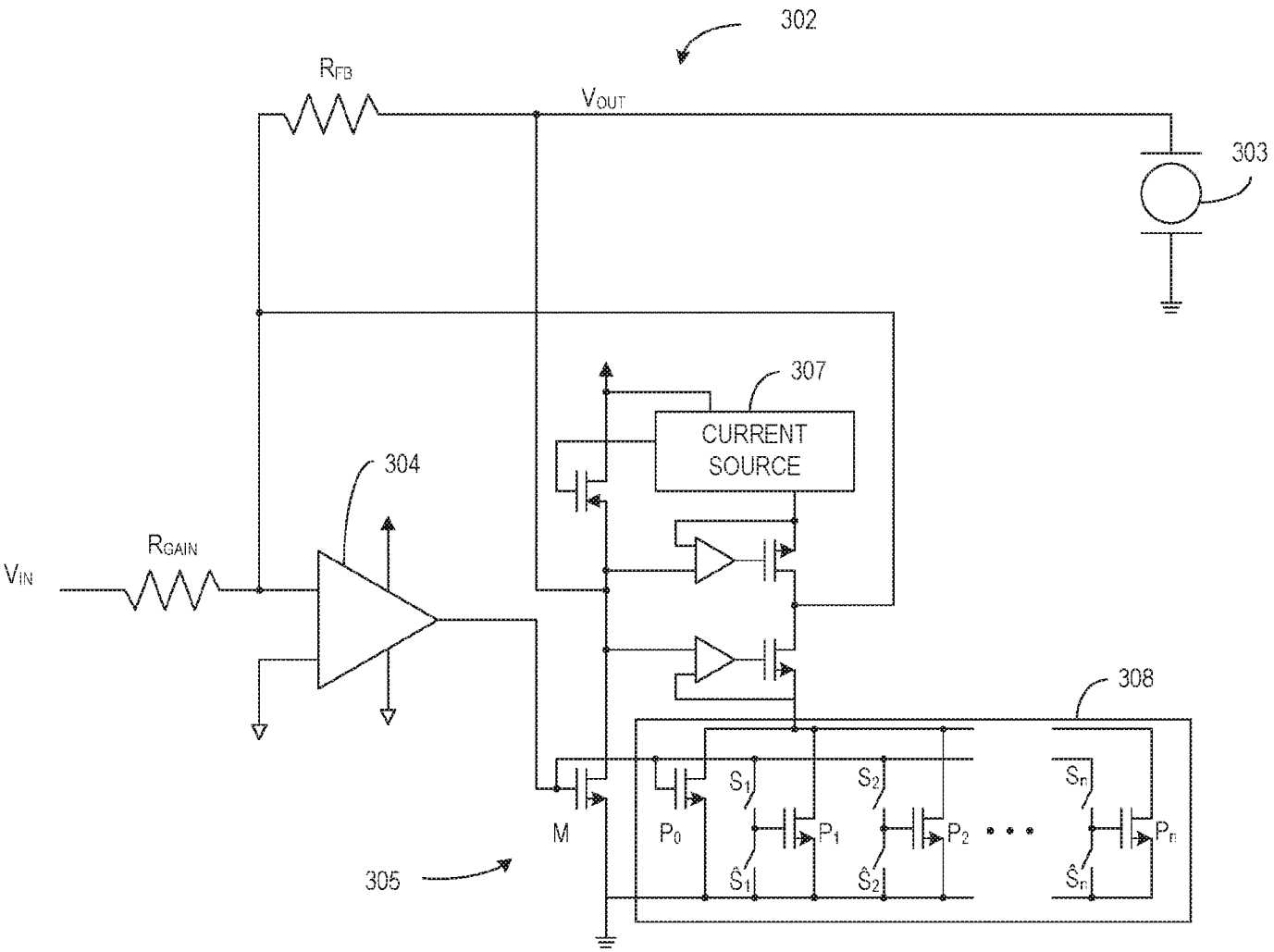
FIG. 3 illustrates generally an example active termination driver 302 including an example implementation of a negative impedance converter.

FIG. 3 illustrates generally an example active termination driver 302 including an example implementation of a negative impedance converter 305 for driving a haptic transducer 303. In certain examples, the active termination driver 302 includes a power amplifier 304, a gain resistor ($R_{GAIN}$), and a feedback resistor ($R_{FB}$). The power amplifier 304 can be coupled to the negative impedance converter 305. The negative impedance converter 305 can include two sets of programmable current sources, a PMOS based current source 307 and an NMOS-based current source 308. The NMOS based current source 308 is shown in detail and can include a number of transistors ($P_0, P_1, \ldots, P_n$) and corresponding switches ($S_1, S_2, \ldots, S_n$) ($\hat{S}_1, \hat{S}_2, \ldots, \hat{S}_n$) to scale the current provided by the NMOS based current source 308. In certain examples, the switches ($S_1, S_2, \ldots, S_n$) ($\hat{S}_1, \hat{S}_2, \ldots, \hat{S}_n$) can be controlled using the processor of the haptic system either for tuning the active termination driver 302 to the haptic transducer 303, for amplifying the back EMF of the haptic transducer 303 for determining the resonant frequency, or for braking the motion of the haptic transducer 303.

ADDITIONAL NOTES

In Example 1, a haptic controller can include an active termination driver having a configurable output impedance, the active termination driver configured to drive a haptic transducer and to process back electro-magnetic force (EMF) of the haptic transducer to provide motion feedback of the haptic transducer, and a processor to provide a command signal to the active termination driver and to determine a resonant frequency of the haptic device using the motion feedback of the haptic transducer.

In Example 2, the active termination driver of Example 1 optionally includes an active element configured to provide the configurable output impedance.

In Example 3, the active element of any one or more of Examples 1-2 optionally includes a negative impedance converter.

In Example 4, the negative impedance converter of any one or more of Examples 1-3 optionally is configured to provide an amplified voltage indicative of the back EMF.

In Example 5, the negative impedance converter of any one or more of Examples 1-4 optionally is configured to receive a digital output from the processor and to provide a negative impedance based on the digital output.

In Example 6, the processor of any one or more of Examples 1-5 optionally is configured to adjust a braking rate of the haptic transducer using the negative feedback converter.

In Example 7, the haptic controller of any one or more of Examples 1-6 optionally includes a peak detector configured to detect at least one of a minimum peak or a maximum peak of the back EMF; and a zero-crossing detector configured to provide timing information to the processor relative to the back EMF crossing a voltage value approximately halfway between the minimum peak and the maximum peak of the back EMF.

In Example 8, a method of operating a haptic transducer controller can include receiving a command signal at an active termination driver from a processor, driving a haptic transducer using the active termination driver and the command signal, processing back EMF of the haptic transducer using the active termination driver to provide motion feedback of the haptic transducer, and determining a resonant frequency of the haptic transducer using the motion feedback of the haptic transducer.

In Example 9, the processing the back EMF of any one or more of Examples 1-8 optionally includes amplifying the back EMF of the haptic transducer to provide the motion feedback using a negative impedance converter.

In Example 10, the method of any one or more of Examples 1-9 optionally includes braking resonant motion of the haptic transducer using the negative impedance converter.

In Example 11, the braking the resonant motion of any one or more of Examples 1-10 optionally includes receiving a impedance information from the processor at the negative impedance converter, and adjusting a negative impedance of the negative impedance converter using the impedance information.

In Example 12, the impedance information of any one or more of Examples 1-11 optionally includes digital impedance information.

In Example 13, the determining a resonant frequency of any one or more of Examples 1-12 optionally includes detecting a period of the resonant frequency using the motion feedback of the haptic transducer.

In Example 14, the detecting a period of any one or more of Examples 1-13 optionally includes driving an output of the active termination driver to predetermined value, and detecting two sequential zero crossings of the back EMF using a zero-crossing detector.

In Example 15, the detecting a period of any one or more of Examples 1-14 optionally includes detecting a maximum peak of the back EMF using a peak detector, detecting a minimum peak of the back EMF using the peak detector, and detecting two sequential crossings of the back EMF of a value halfway between the minimum peak and the maximum peak using a zero-crossing detector.

In Example 16, a system can include a resonant haptic transducer; and a haptic controller configured to couple to the resonant haptic transducer. The haptic controller can include an active termination driver configured to drive a haptic transducer and to process back electro-magnetic force (EMF) to provide motion feedback of the haptic transducer, and a processor to provide a command signal to the active termination driver and to determine a resonant frequency of the haptic device using the motion feedback of the haptic transducer.

In Example 17, the active termination driver of any one or more of Examples 1-16 optionally includes a negative impedance converter.

In Example 18, the negative impedance converter of any one or more of Examples 1-17 optionally is configured to provide an amplified voltage indicative of the back EMF.

In Example 19, the negative impedance converter of any one or more of Examples 1-18 optionally is configured to receive a digital output from the processor and to provide a negative impedance based on a value of the digital output.

In Example 20, the processor of any one or more of Examples 1-19 optionally is configured to adjust a braking rate of the haptic transducer using the negative feedback converter. In Example 21, the haptic controller of any one or more of Examples 1-20 optionally includes a peak detector configured to detect at least one of a minimum peak or a maximum peak of the back EMF, and a zero-crossing detector configured to provide timing information to the processor relative to the back EMF crossing a voltage value approximately halfway between the minimum peak and the maximum peak of the back EMF.

Example 22 can include, or can optionally be combined with any portion or combination of any portions of any one or more of Examples 1 through 21 to include, subject matter that can include means for performing any one or more of the functions of Examples 1 through 21, or a machine-readable medium including instructions that, when performed by a machine, cause the machine to perform any one or more of the functions of Examples 1 through 21.

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A haptic controller comprising:

an active termination driver having a configurable output impedance, the active termination driver configured to drive a haptic transducer and to process back electromagnetic force (EMF) of the haptic transducer to provide motion feedback of the haptic transducer;

a processor to provide a command signal to the active termination driver and to determine a resonant frequency of the haptic device using the motion feedback of the haptic transducer;

a peak detector configured to detect at least one of a minimum peak or a maximum peak of the back EMF: and a zero-crossing detector configured to provide timing information to the processor relative to the back EMF crossing a voltage value approximately halfway between the minimum peak and the maximum peak of the back EMF.

2. The haptic controller of claim 1, wherein the active termination driver includes an active element configured to provide the configurable output impedance.

3. The haptic controller of claim 2, wherein the active element includes a negative impedance converter.

4. The haptic controller of claim 3, wherein the negative pedance converter is configured to provide an amplified voltage indicative of the back EMF.

5. The haptic controller of claim 4, wherein the negative impedance converter is configured to receive a digital output from the processor and to provide a negative impedance based on the digital output.

6. The haptic controller of claim 1, wherein the processor is configured to adjust a braking rate of the haptic transducer using a negative impedance converter.

7. A method comprising:

receiving a command signal at an active termination driver from a processor; driving a haptic transducer using the active termination driver and the command signal;

processing back EMF of the haptic transducer using the active termination driver to provide motion feedback of the haptic transducer; and determining a resonant frequency of the haptic transducer using the motion feedback of the haptic transducer;

wherein the determining a resonant frequency of the haptic transducer includes detecting a period of the resonant frequency using the motion feedback of the haptic transducer; and wherein the detecting a period includes;

detecting a maximum peak of the back EMF using a peak detector;

detecting a minimum peak of the back EMF using the peak detector; and detecting two sequential crossings of the back EMF of a value halfway between the minimum peak and the maximum peak using a zero-crossing detector.

8. The method of claim 7, wherein processing the back EMF includes amplifying the back EMF of the haptic transducer to provide the motion feedback using a negative impedance converter.

9. The method of claim 8, including braking resonant otion of the haptic transducer using the negative impedance converter.

10. The method of claim 9, wherein braking the resonant motion includes receiving a impedance information from the processor at the negative impedance converter; and adjusting a negative impedance of the negative impedance converter using the impedance information.

11. The method of claim 10, wherein the impedance information includes digital impedance information.

12. The method of claim 7, wherein detecting a period includes driving an output of the active termination driver to predetermined value; and detecting two sequential zero crossings of the back EMF using a zero-crossing detector.

13. A system comprising:

a resonant haptic transducer; and haptic controller configured to couple to the resonant haptic transducer, the haptic controller including:

an active termination driver configured to drive a haptic transducer and to process back electro-magnetic force (EMF) to provide motion feedback of the haptic transducer;

a processor to provide a command signal to the active termination driver and to determine a resonant frequency of the haptic device using the motion feedback of the haptic transducer a peak detector configured to detect at least one of a minimum peak or a maximum peak of the back EMF; and a zero-crossing detector configured to provide timing information to the processor relative to the back EMF crossing a voltage value approximately halfway between the minimum peak and the maximum peak of the back EMF.

14. The haptic controller of claim 13, wherein the active termination driver includes a negative impedance converter.

15. The haptic controller of claim 14, wherein the negative impedance converter is configured to provide an amplified voltage indicative of the back EMF.

16. The haptic controller of claim 14, wherein the negative impedance converter is configured to receive a digital output from the processor and to provide a negative impedance based on a value of the digital output.

17. Wreviously Presented) The haptic controller of claim 13, wherein the processor is configured to adjust a braking rate of the haptic transducer using a negative impedance converter.

* * * * *